US009871318B2

(12) United States Patent
Wang

(10) Patent No.: US 9,871,318 B2
(45) Date of Patent: Jan. 16, 2018

(54) WATERPROOF ELECTRICAL CONNECTOR HAVING A SEALER BETWEEN CONATCT MODULE AND OUTER SHELL

(71) Applicant: FOXCONN INTERCONNECT TECHNOLOGY LIMITED, Grand Cayman (KY)

(72) Inventor: Cai-Yuan Wang, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/499,920

(22) Filed: Apr. 28, 2017

(65) Prior Publication Data

US 2017/0317443 A1 Nov. 2, 2017

(30) Foreign Application Priority Data

Apr. 28, 2016 (CN) ..... 2016 1 0271658

(51) Int. Cl.

| | |
|---|---|
| ***H01R 24/00*** | (2011.01) |
| ***H01R 13/52*** | (2006.01) |
| ***H01R 13/516*** | (2006.01) |
| ***H01R 13/405*** | (2006.01) |

(52) U.S. Cl.

CPC ..... *H01R 13/5219* (2013.01); *H01R 13/405* (2013.01); *H01R 13/516* (2013.01); *H01R 13/5227* (2013.01)

(58) Field of Classification Search

CPC ..... H01R 23/7073; H01R 23/7005

USPC ..... 439/660, 626, 374, 377, 79, 733

See application file for complete search history.

(56) References Cited

U.S. PATENT DOCUMENTS

| | | | | |
|---|---|---|---|---|
| 6,890,220 | B2 * | 5/2005 | Wang | H01R 13/64 439/677 |
| 8,262,411 | B2 * | 9/2012 | Kondo | H01R 13/6658 439/607.01 |
| 8,808,029 | B2 * | 8/2014 | Castillo | H01R 13/6585 439/607.05 |

(Continued)

FOREIGN PATENT DOCUMENTS

| | | |
|---|---|---|
| CN | 204088689 | 1/2015 |
| CN | 105449398 | 3/2016 |

(Continued)

*Primary Examiner* — Phuong Chi T Nguyen

(74) *Attorney, Agent, or Firm* — Wei Te Chung; Ming Chieh Chang

(57) ABSTRACT

An electrical connector includes: a contact module having an insulative housing, two rows of terminals affixed to the insulative housing, and a metal shielding plate, the insulative housing comprising an annular receiving groove, a base portion located behind the annular receiving groove, and a tongue portion extending forwardly from the annular receiving groove, each terminal having a contacting portion exposed to a surface of the tongue portion, a soldering portion, and a connecting portion; an inner metal shell attached to the contact module; and an outer shell enclosing the inner metal shell; the connecting portion has an exposed portion located at a rear end of the connecting portion and suspended in the annular receiving groove, the annular receiving groove receives glue to form a sealer sealing between the contact module and the outer shell, and the exposed portion is embedded in the glue.

6 Claims, 11 Drawing Sheets

(56) References Cited

U.S. PATENT DOCUMENTS

| | | | | |
|---|---|---|---|---|
| 2016/0104957 | A1 | 4/2016 | Kim | |
| 2016/0294105 | A1* | 10/2016 | Zhao | H01R 13/5202 |

FOREIGN PATENT DOCUMENTS

| | | |
|---|---|---|
| CN | 105470697 | 4/2016 |
| TW | M497364 | 3/2015 |

* cited by examiner

WATERPROOF ELECTRICAL CONNECTOR HAVING A SEALER BETWEEN CONATCT MODULE AND OUTER SHELL

BACKGROUND OF THE DISCLOSURE

1. Field of the Disclosure

The present disclosure relates to a waterproof electrical connector having a sealing member sealed between a contact module and an outer shell, and more particularly to exposed contact portions of the contact module that are embedded in the sealing member.

2. Description of Related Arts

China Patent No. 204088689 discloses an electrical connector comprising an upper insulative housing, a row of upper terminals affixed to the upper insulative housing, a lower insulative housing, and a row of lower terminals affixed to the lower insulative housing. During manufacturing, exposed terminal portions through a first and second receiving rooms of the upper and lower insulative housings are injected with molten plastics to form a contact module.

U.S. Patent Application Publication No. 2016/0294105 discloses an electrical connector comprising a contact module having an annular receiving groove, an inner metal shell, an outer shell, and a sealer. An opening used for injecting glue is formed at an upper surface of the contact module. The inner metal shell is assembled to the contact module. The glue flows into the annular receiving groove to form a sealer.

An improved electrical connector is desired.

SUMMARY OF THE DISCLOSURE

Accordingly, an object of the present disclosure is to provide an electrical connector ensuring the waterproof effect of the electrical connector.

To achieve the above object, an electrical connector comprises: a contact module having an insulative housing, a number of terminals in two rows affixed to the insulative housing, and a metal shielding plate, the insulative housing comprising an annular receiving groove, a base portion located behind the annular receiving groove, and a tongue portion extending forwardly from the annular receiving groove, each terminal comprising a contacting portion exposed to a surface of the tongue portion, a soldering portion, and a connecting portion between the contacting portion and the soldering portion; an inner metal shell attached to the contact module; and an outer shell enclosing the inner metal shell; wherein the connecting portion has an exposed portion located at a rear end of the connecting portion and suspended in the annular receiving groove, the annular receiving groove receives glue to form a sealer sealing between the contact module and the outer shell, and the exposed portion is embedded in the glue.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
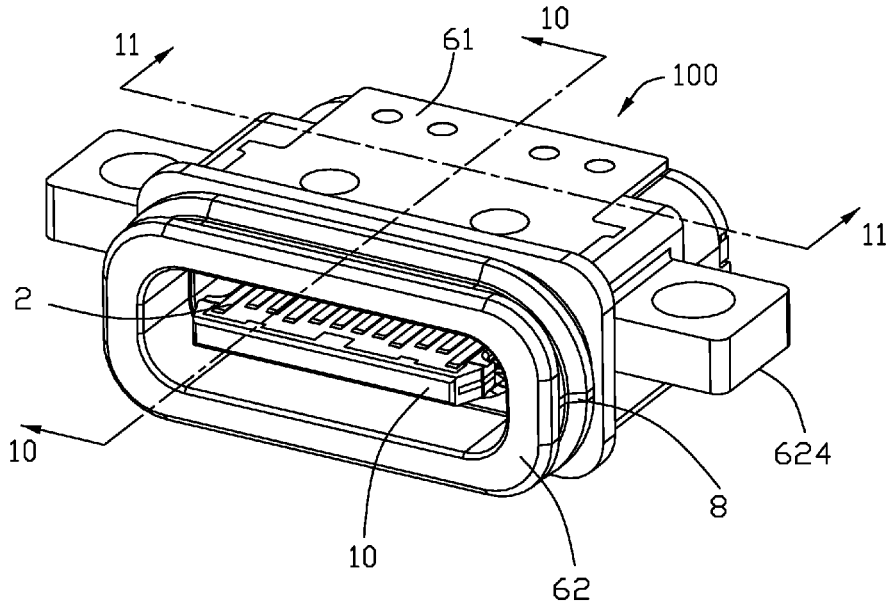
FIG. 1 is a perspective, assembled view of an electrical connector.
Figure 2:
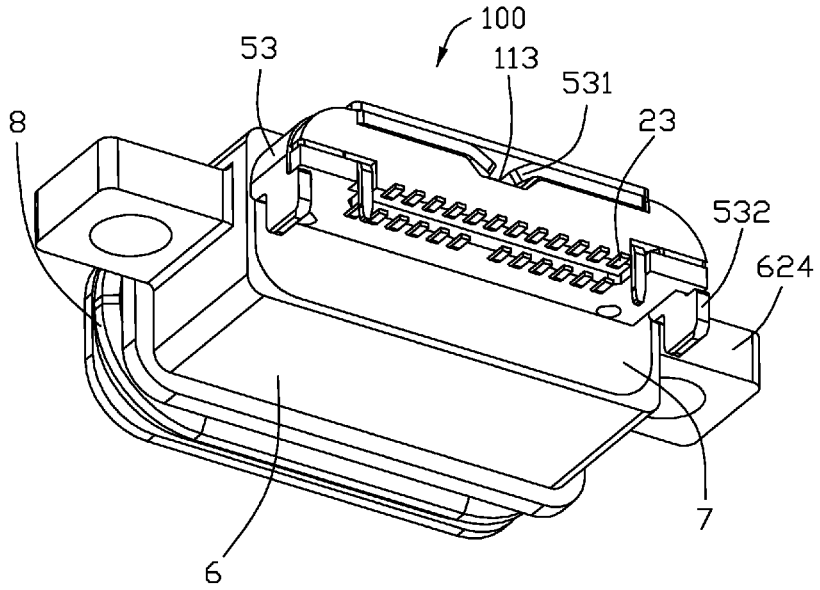
FIG. 2 is another perspective, assembled view of the electrical connector taken from FIG. 1.
Figure 3:
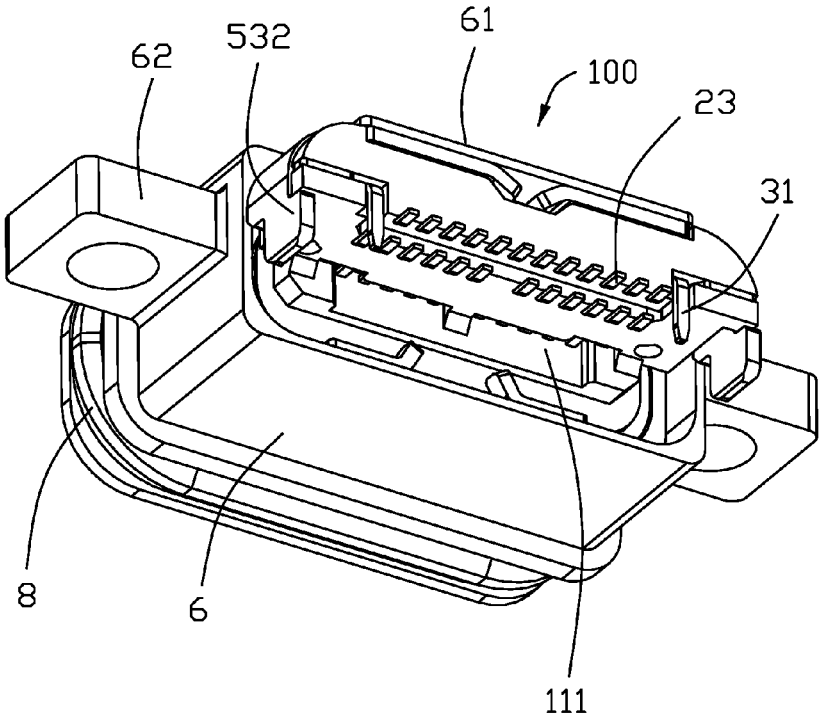
FIG. 3 is a perspective, assembled view of the electrical connector removing the sealer.

Reference will now be made in detail to the embodiments of the present disclosure.

Referring to FIGS. 1 to 11, an electrical connector 100 comprises a contact module 10, an inner metal shell 5 attached to the contact module 10, an outer shell 6 enclosing the inner metal shell 5, a sealer 7 made from glue, and an o-ring 8 attached to a front end of the outer shell 6.

Figure 6:
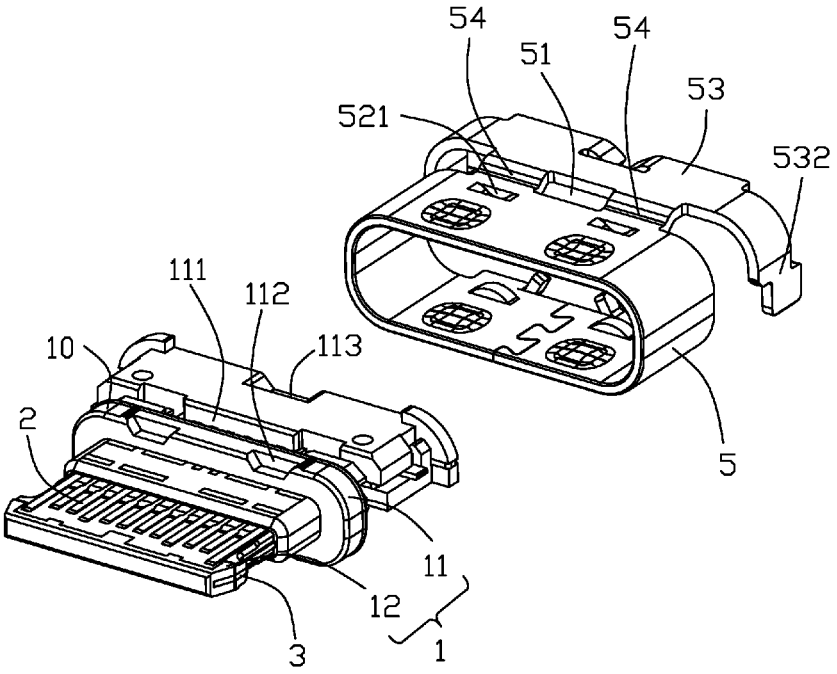
FIG. 6 is an exploded view of the contact module and the inner metal shell.
Figure 7:
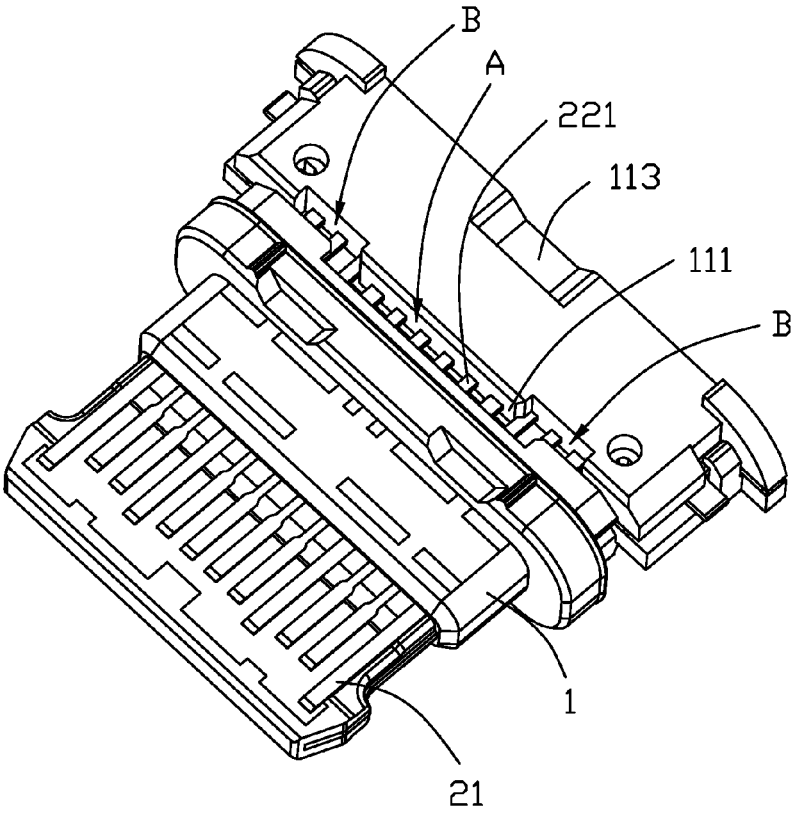
FIG. 7 is a perspective, assembled view of the contact module of the electrical connector.
Figure 8:
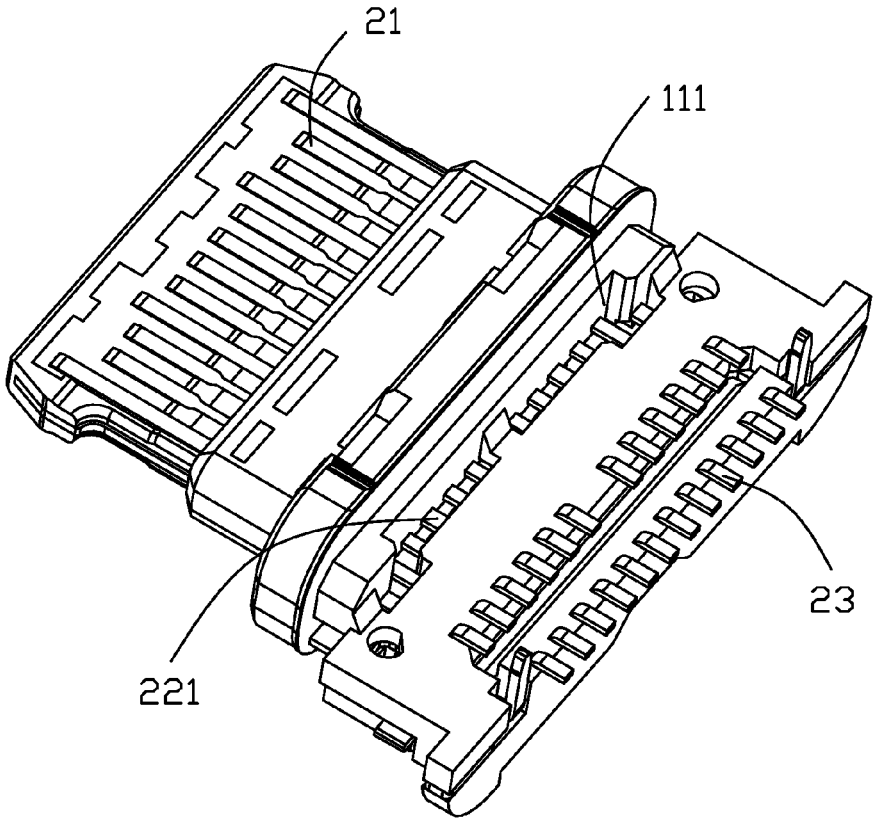
FIG. 8 is another assembled view of the contact module taken from FIG. 7.

Referring to FIGS. 6 to 8, the contact module 10 includes an insulative housing 1 having an annular receiving groove 111, a base portion 11 located behind the annular receiving groove 111, and a tongue portion 12 extending forwardly from the annular receiving groove 111, a number of terminals 2 affixed to the insulative housing 1 in two rows, and a shielding plate 3. The terminals 2 include a number of upper terminals and lower terminals arranged in a vertical direction. Referring to FIGS. 6 to 9, the contact module 10 includes an upper module having a first insulator 1*a* and the upper terminals affixed to the first insulator 1*a*, a lower module having a second insulator 1*b* and the lower terminals affixed to the second insulator, the shielding plate 3 sandwiched between the first insulator 1*a* and the second insulator 1*b*, and a third insulator 1*c* over-molded with the first insulator 1*a* and the second insulator 1*b*. A rear end of the first insulator 1*a*, a rear end of the second insulator 1*b*, and a rear end of the third insulator 1*c* form the base portion 11. A front end of the first insulator 1*a*, a front end of the second insulator 1*b*, and a front end of the third insulator 1*c* form the tongue portion 12. One of the first insulator 1*a* and the second insulator 1*b* includes a hook 14, and the other includes a through hole 15 mated with the hook 14. The base portion 11 includes a number of resisting grooves 112 in a front end thereof, the annular receiving groove 111 located behind the resisting grooves 112 and surround the base portion 11, and a receiving slot 113 located at a rear end of the annular receiving groove 111.

Referring to FIGS. 6-8 and 10-11, each terminal 2 includes a contacting portion 21, a soldering portion 23 grounded to a PCB, and a connecting portion 22 connecting the contacting portion 21 and the soldering portion 23. The connecting portion 22 includes an exposed portion 221 located at a rear end of the connecting portion and suspended in the annular receiving groove 111 and being enclosed by glue. The exposed portion 221 is exposed to an upper surface and a lower surface of the base portion 11 and embedded in the sealer 7.

Figure 9:
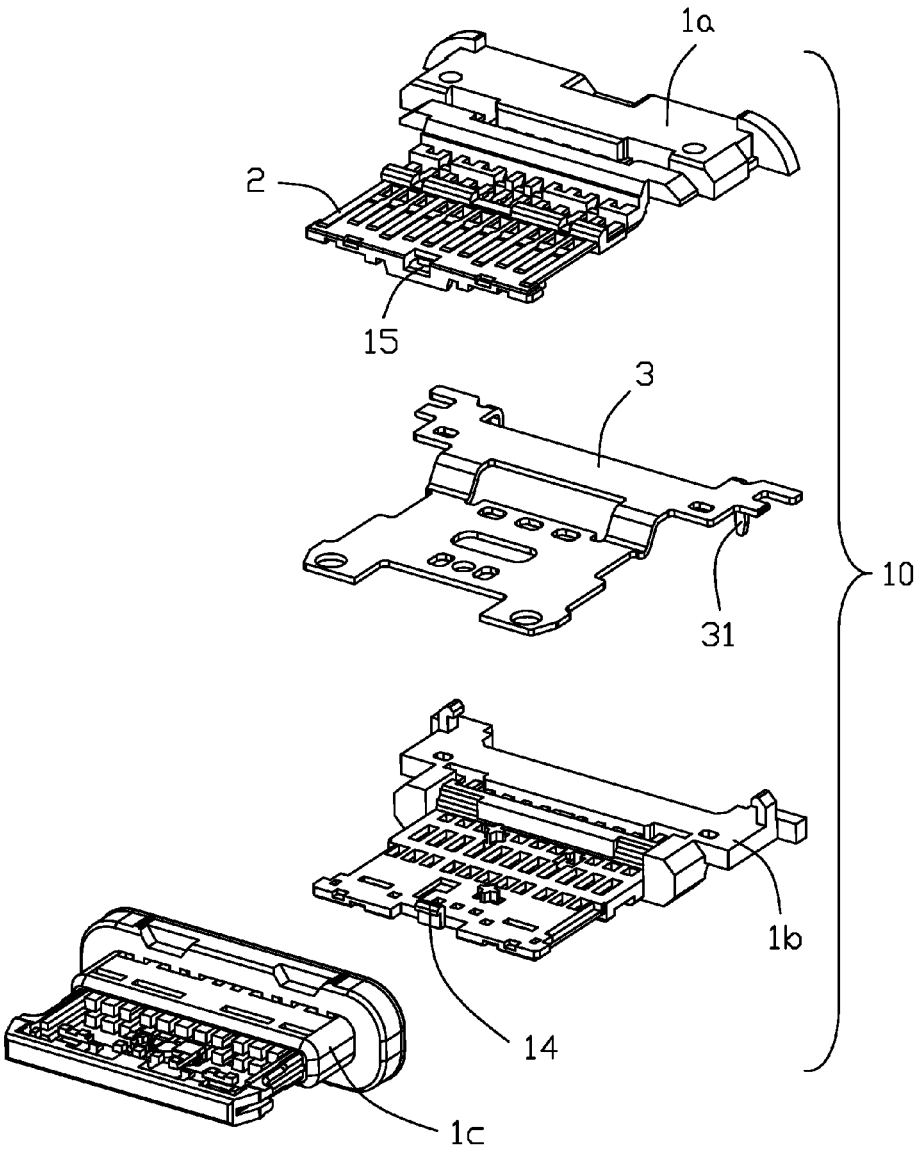
FIG. 9 is an exploded view of the contact module of the electrical connector.

Referring to FIG. 9, the shielding plate 3 includes a pair of ground pins 31 in the rear end thereof.

Figure 4:
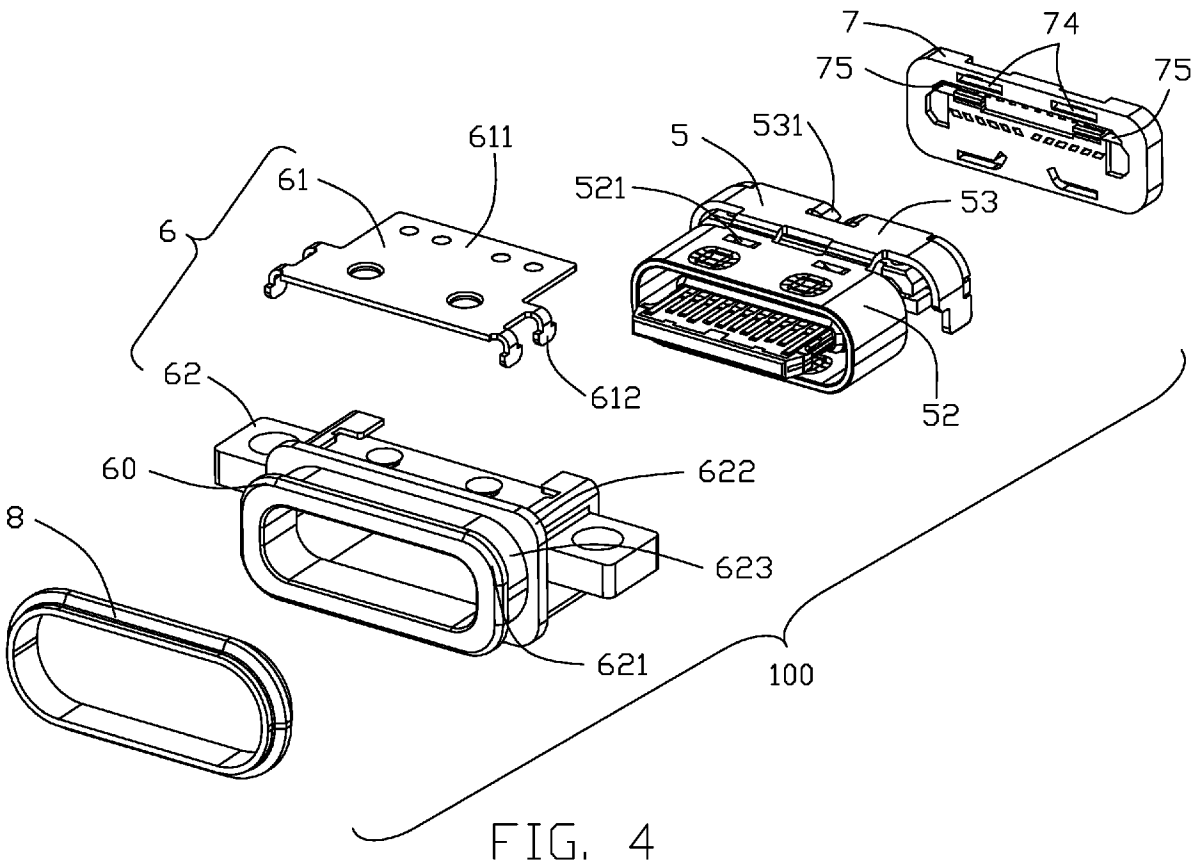
FIG. 4 is a partial exploded view of the electrical connector when the inner metal shell is attached to the contact module.
Figure 5:
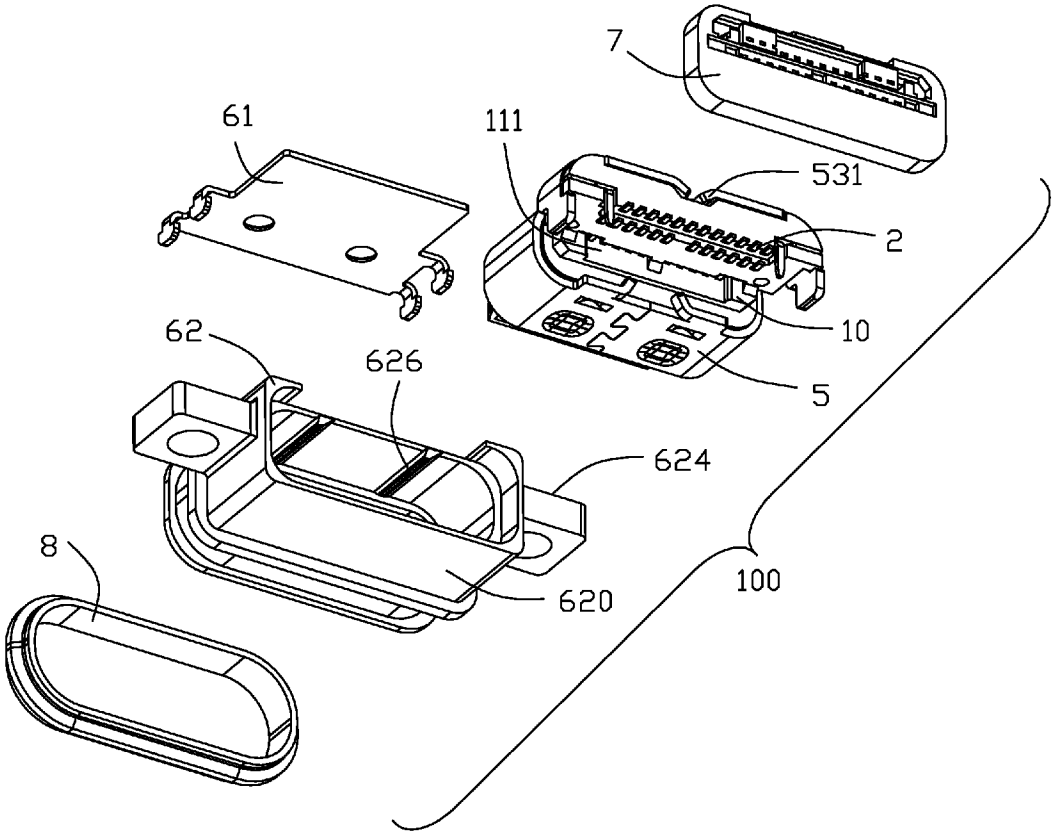
FIG. 5 is another exploded view of the electrical connector taken from FIG. 4.

Referring to FIG. 4, the inner metal shell 5 includes a main portion 52 shaped cylindrically, a rear portion 53 located behind the main portion 52 and extending upwardly and rearward from the main portion 52, and a penetrating groove 51 formed between the main portion 52 and the rear portion 53 and penetrating the annular receiving groove 111. The main portion 52 includes a number of tubers 521 protruding inwardly. An upper surface of the rear portion 53 is higher than an upper surface of the main portion 52. The rear portion 53 includes a pair of fixed parts 532 extending downwardly from the lateral therefrom and a pair of bending portions 531.

Figure 10:
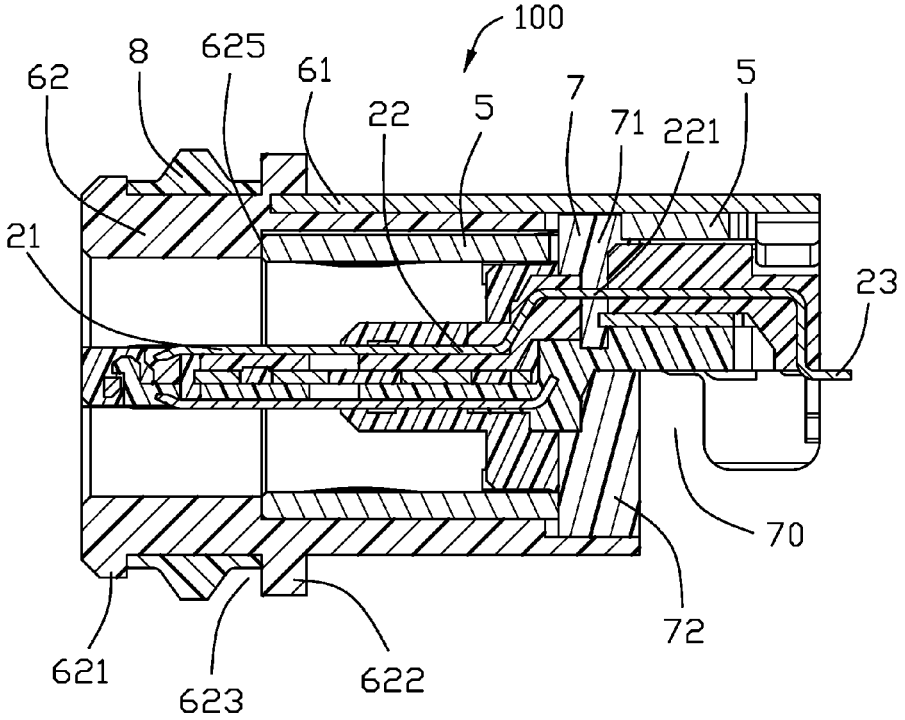
FIG. 10 is a cross-sectional view of the electrical connector along line 10-10 in FIG. 1.
Figure 11:
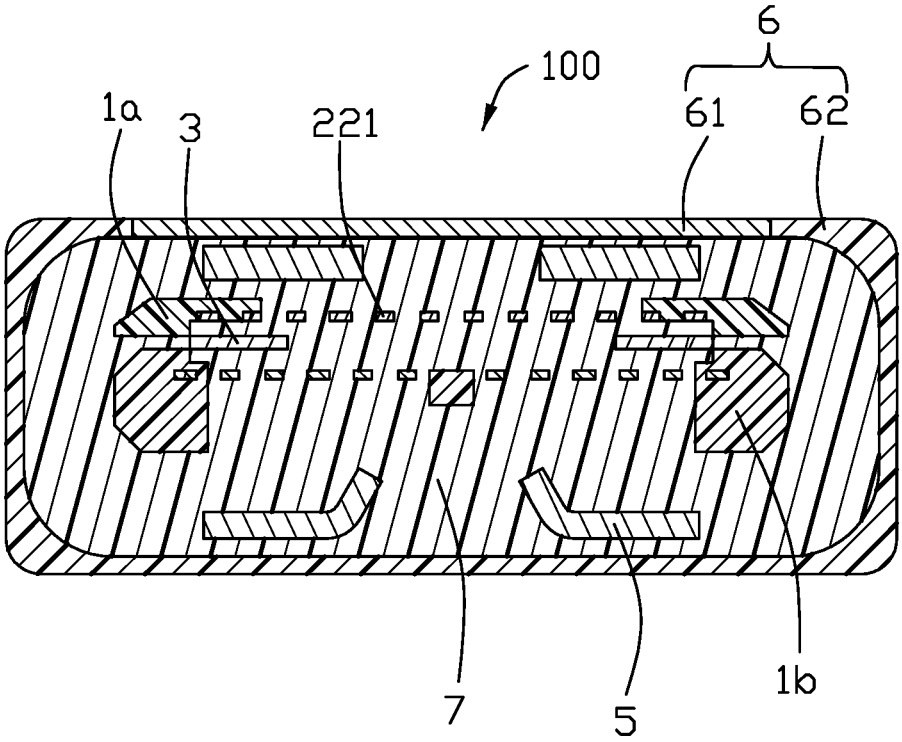
FIG. 11 is a cross-sectional view of the electrical connector along line 11-11 in FIG. 1.

Referring to FIGS. 4 and 10, the outer shell 6 includes a reinforcing plate 61 and an insulative shell 62 insert-molded with the reinforcing plate 61. The insulative shell 62 includes a tubular portion 620, a pair of installing portions 624 extending outwardly from the lateral sides of the tubular portion 620, a front blocking portion 621, a rear blocking portion 622 and a notch 623 located between the first blocking portion 622 and the rear blocking portion 623. The insulative shell 62 includes a stepped portion 625 from an inner surface of the insulative shell and a pair of ribs 626 extending forwardly and rearward. The reinforcing plate 61 includes a main part 611 and a number of holding portions 612 extending downwardly from the main part 611.

Referring to FIGS. 1 to 11, the method of making the electrical connector 100 is as follows.

First step: The contact module is made by insert molding with two means. The insulative housing 1, the terminals 2 in two rows, and the shielding plate 3 are insert-molded to be an integrated. Then insert mold the integrated with insulative material to be the contact module 10. The other mean is to form the upper module having the first insulator 1*a* and the upper terminals and the lower module having the second insulator 1*b* and the lower terminals. Then affix the shielding plate sandwiched between the upper module and the lower module to be an integrated by the hook 14 latching the through hole 15. Then insert mold the integrated with insulative material to be the contact module 10. The insulative material forms the third insulator 1*c*. The base portion 11 includes the annular receiving groove 111 in two means. The connecting portion 22 includes the exposed portion 221 suspended in and exposed to the annular receiving groove 111 in two means.

Second step: The inner metal shell 5 is attached to the contact module 10. The tubers 521 resist the resisting grooves 112. The pair of bending portions 531 inserts into the receiving slot 113. Provide the reinforcing plate 61 and insert mold the reinforcing plate 61 with the insulative shell 62 to form the outer shell 6. Assemble the holding parts 612 to the tubular portion 620. The outer shell 6 encloses the inner metal shell 5 while a front end of the inner metal shell 5 resists against the stepped portion 625.

Third step: The glue is injected into the annular receiving groove 111 from a rear end of the lower part of the base portion and goes through the penetrating groove 51 to form the sealer 7. The sealer includes a lower portion 72 located under the base portion 11 and forming a space 70 between a rear end of the base portion. The lower portion 72 is rearward exposed to an exterior. The bottom edge and the lateral edge of the sealer are attached to the insulative shell 62. After insert-molding process, the glue covers the exposed portion 221. The sealer 7 includes an upper portion 71 above the base portion 11 located between the outer shell 6 and the rear portion 53 in a front-to-back direction. An upper edge of the sealer 7 is attached to reinforcing plate 61. The sealer 7 seals the gap between the outer shell 6 and the contact module 10 in the rear end. The glue could be replaced by liquid silicone or other material different from the insulative material of the insulative housing 1.

Fourth step: The o-ring 8 is attached to the notch 623. The o-ring 8 may be formed by pouring waterproof material into the notch 623, such as glue, resin, liquid silicone or other materials. The forth step may occur in the second step of forming the outer shell 6 or may also occur after the third step.

Compared with the prior technology, one feature of the invention is to have the inner metal shell 5 and the outer shell 6 first mounted to the contact module 10 and then pour the glue so that the sealer 7 is wall-shaped to seal the gap among the outer shell 6, the inner metal shell 5 and the contact module 10 simultaneously. The exposed portion 221 is enwrapped with glue instead of being enwrapped by the insulating housing 1 so that the waterproof material is less likely to be peeled off from the terminals 2 when the temperature is too high. Therefore, on one hand the inner metal shell 5 is required to provide the penetrating groove 51 to allow the glue to pass therethrough. On the other hand, the sealer 7 forms corresponding openings 74 to allow the linking sections 54 of the inner metal shell 5 to pass therethrough. Similarly, the sealer 7 further forms corresponding openings 75 to allow the housing 1 to pass therethrough. Another feature of the invention is to have the annular receiving groove 111 extend in an offset manner rather in a planar manner as shown in regions A and B (FIG. 7) to comply with the configuration of the housing 1 so as to have the whole structure of the corresponding sealer 7 more strong.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a contact module having an insulative housing, a plurality of terminals in two rows affixed to the insulative housing, and a metal shielding plate, the insulative housing comprising an annular receiving groove, a base portion located behind the annular receiving groove, and a tongue portion extending forwardly from the annular receiving groove, each terminal comprising a contacting portion exposed to a surface of the tongue portion, a soldering portion, and a connecting portion between the contacting portion and the soldering portion;

an inner metal shell attached to the contact module; and an outer shell enclosing the inner metal shell; wherein the connecting portion has an exposed portion located around a rear end of the connecting portion and suspended in the annular receiving groove, the annular receiving groove receives glue to form a sealer sealing among the contact module, the inner metal shell and the outer shell, and the exposed portion is embedded in the glue;

wherein the sealer comprises a lower portion located under the base portion and is rearward exposed to an exterior;

wherein the inner metal shell comprises a penetrating groove penetrating the annular receiving groove, the glue enters the penetrating groove through the annular receiving groove, and an outer surface of the sealer is attached to an inner surface of the outer shell;

wherein the inner metal shell comprises a rear portion extending upwardly and rearward in a rear end thereof, and the sealer comprises an upper portion located above the base portion and between the outer shell and the rear portion in a front-to-rear direction;

wherein the outer shell comprises a reinforcing plate and an insulative shell insert-molded with the reinforcing plate, the upper portion is attached to the reinforcing plate, and the lower portion is attached to the insulative shell and located at the rear end of the inner metal shell.

2. The electrical connector as claimed in claim 1, further comprising an o-ring, and wherein the insulative shell comprises a front blocking portion protruding outwardly from the outer surface of the insulative shell, a rear blocking portion separated from the front blocking portion and protruding outwardly from the outer surface of the insulative shell, and a notch formed between the front blocking portion and the rear blocking portion, the o-ring attached to the notch.

3. A method of making an electrical connector, comprising the steps of:

insert molding a contact module to comprise an insulative housing and a plurality of terminals in two rows affixed to the insulative housing, the insulative housing comprising an annular receiving groove, a base portion located behind the annular receiving groove, and a tongue portion extending forwardly from the annular receiving groove, each terminal comprising a contacting portion exposed to the surface of the tongue portion, a soldering portion and a connecting portion connected between the contacting portion and the soldering portion, the connecting portion comprising an exposed portion suspended in the annular receiving groove;

attaching an inner metal shell to the contact module and enclosing an outer shell to the inner metal shell;

injecting glue into the annular receiving groove to form a sealer sealing among the contact module, the inner metal shell and the outer shell; and the exposed portion being embedded in the glue;

a step of insert-molding a reinforcing plate with an insulative shell to form the outer shell.

4. The method as claimed in claim 3, wherein the step of injecting comprises embedding the exposed portions of terminals.

5. The method as claimed in claim 3, further comprising a step of insert molding waterproof materials with a front end of the outer shell to form an o-ring.

6. An electrical connector comprising:

contact module including an insulative housing associated with a plurality of terminals therein, each of said terminals including a front contacting portion, a rear soldering portion and a middle connecting portion linked therebetween along a front-to-back direction, the housing forming a receiving groove to expose the connecting portions of said terminals;

a metallic inner shell enclosing the contact module;

an outer shell attached upon the inner shell; and a glue filled within the receiving groove to form a sealer intimately contacting the connecting portions, the inner shell and the outer shell;

wherein the sealer forms an opening through which a linking portion of the inner shell extends in said front-to-back direction;

wherein the sealer forms an opening through which a portion of the housing extends in said front-to-back direction;

wherein said receiving groove forms two regions spaced from each other in a transverse direction perpendicular to said front-to-back direction, and offset from each other in said front-to-back direction;

wherein said outer shell includes an insulative shell associate with a metallic reinforced plate soldered to the metallic inner shell;

wherein said metallic inner shell forms a penetrating groove through which the sealer extends in a vertical direction perpendicular to said front-to-back direction;

wherein said housing includes a tongue portion and a base portion, and the annular receiving groove is located between the tongue portion and the base portion.

* * * * *